US006530133B2

(12) United States Patent
Meyrat et al.

(10) Patent No.: US 6,530,133 B2
(45) Date of Patent: Mar. 11, 2003

(54) CLASP FOR WATCH WRISTBAND

(75) Inventors: Clément Meyrat, Le Landeron (CH); Nicolas Ehrsam, Evilard (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/940,525

(22) Filed: Aug. 29, 2001

(65) Prior Publication Data

US 2002/0023323 A1 Feb. 28, 2002

(30) Foreign Application Priority Data

Aug. 31, 2000 (CH) ..... 1696/00

(51) Int. Cl.[7] ..... A44B 11/25

(52) U.S. Cl. ..... 24/615; 24/265 EC; 24/625; 24/265 WS

(58) Field of Search ..... 24/614, 615, 265 EC, 24/265 WS, 265 BC, 265 B, 656, 616, 326, 625; 403/291

(56) References Cited

U.S. PATENT DOCUMENTS 4,035,877 A * 7/1977 Brownson et al. ..... 24/171
4,539,736 A * 9/1985 Yokosuka ..... 24/265 WS
4,770,008 A * 9/1988 Yamaura ..... 224/175
4,928,364 A * 5/1990 Ikeda ..... 24/171
5,323,554 A * 6/1994 MacDonald ..... 224/219
5,427,562 A * 6/1995 Hwang ..... 450/58
5,774,957 A * 7/1998 Kohl et al. ..... 24/616
6,135,692 A * 10/2000 Lary ..... 411/530
6,154,936 A * 12/2000 Howell et al. ..... 24/625
6,233,793 B1 * 5/2001 Wanzenbock ..... 24/614
6,360,404 B1 * 3/2002 Mudge et al. ..... 119/865

FOREIGN PATENT DOCUMENTS

| | | |
|---|---|---|
| DE | 2 328 370 | 12/1974 |
| DE | 25 39 277 | 3/1977 |
| EP | 197 331 | 10/1986 |

* cited by examiner

*Primary Examiner*—Robert J. Sandy
*Assistant Examiner*—André L. Jackson
(74) *Attorney, Agent, or Firm*—Sughrue Mion, PLLC

(57) ABSTRACT

A clasp for a watch wristband includes: two male (2) and female (4) joining parts able to be coupled by inserting the male part (2) into the female part (4); and a resilient locking mechanism, provided on the male part (2), locking with a catching mechanism provided on the female part (4), when the male part (2) is pushed into an engagement position in said female part (4) so that it is then impossible to pull outwardly the male joining part (2), the male (2) and female (4) joining parts being able to be uncoupled from each other by pushing the male part (2) further into the female part (4) so that the locking mechanism is released from the catching mechanism and the male joining part (2) can be pulled out of the female joining part (4).

15 Claims, 4 Drawing Sheets

Fig. 8
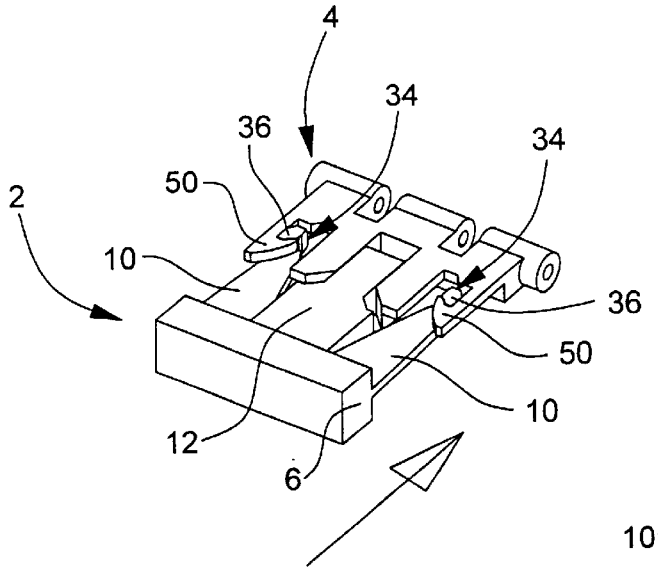
Fig. 9
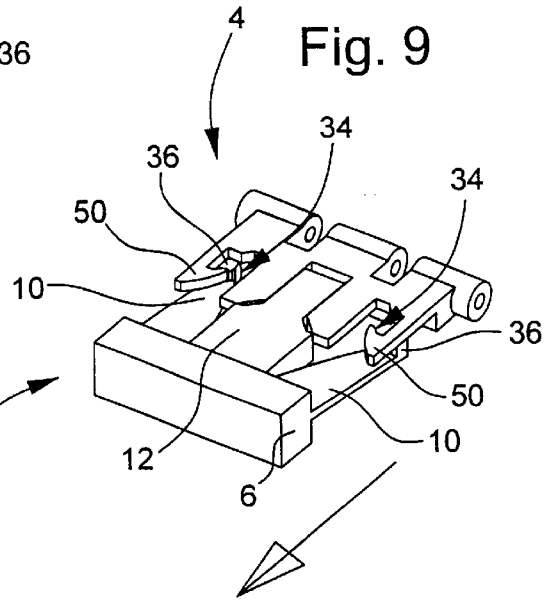
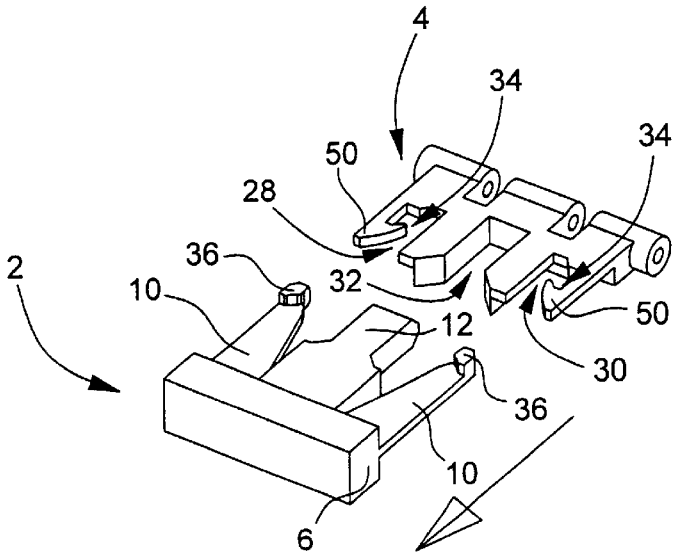
Fig. 10

CLASP FOR WATCH WRISTBAND

BACKGROUND OF THE INVENTION

The present invention concerns a clasp of the type allowing a first and second strand of a watch wristband to be connected.

Clasps for watch wristbands have to answer a certain number of criteria. They have, in particular, to be easy to use, offer total operating security, and be inexpensive to manufacture.

Numerous clasps of the type concerned are known, certain of which answer the aforecited conditions quite well, but have, however, certain drawbacks. Some are for example expensive to manufacture, while others, which are easier to manufacture, are difficult to handle. In this respect, many known clasps are particularly difficult to handle because, in order to assemble or separate the two parts of the clasp, one part has to be pivoted with respect to the other.

Moreover, a large number of known clasps have a shape requiring special manufacturing operations, in particular multiple machining stages, or expensive injection moulds in several parts which increase manufacturing costs.

Such is the case, particularly, of clasps of the unfolding type which, in their simplest embodiment, comprise a basic strip onto which a pivoting strip can be folded down. These strips are attached to each other by one of their ends by means of a hinge, and usually include a snap fitting device allowing one to snapped onto the other in the closed position. In addition to the fact that these unfolding strip clasps have complex shapes which make them difficult and thus expensive to manufacture, they are also often inconvenient to use. Moreover, these systems have the drawback of wearing out quickly and no longer snapping the clasp properly into place after a relatively low number of opening and closing movements. This is essentially due to a high snapping force and, therefore, rapid wear of the system. Further, it frequently occurs that the user inadvertently catches one of the strips of the clasp unintentionally causing it to open, at the risk of losing the watch.

Clasps for open wristbands are also known which allow a first and a second wristband strand to be connected to each other. These clasps conventionally include a buckle and tongue secured using a rod at the free end of one of the strands. The free end of the other strand is passed under the buckle then immobilised by the tongue which penetrates in one of the holes made in said strand. This end can then be slid under a loop which holds it.

Clasps with a buckle have the main advantage of being simple and thus inexpensive to manufacture. However, it frequently occurs that the person wearing the watch lets go of it when he wishes to secure it to his wrist, so that the watch can be damaged by falling. These clasps are also unattractive and consequently increasingly fail to meet the expectations of clients who are looking for watches of more sophisticated design and operation, without however being prepared to sacrifice simplicity of use.

Finally, wristbands which are fastened by means of a clasp with a buckle tend to wear out quickly. This is particularly true for the strand in which the holes intended to receive the tongue are made. Indeed, since a given user always inserts the tongue into the same hole of the wristband, this hole tends to get bigger and to tear. Likewise, a fold is formed at the place where the strand passes under the buckle, such fold also making the wristband fragile and liable to tear.

The object of the present invention is thus to make a wristband clasp for a watch which avoids the aforecited drawbacks, and which is very simple to manufacture and easy and secure to use.

SUMMARY OF THE INVENTION

The present invention thus concerns a watch wristband clasp, characterised in that it includes two male and female joining parts able to be, coupled by inserting the male part into the female part, resilient locking means, provided on the male part, locking with catching means provided on the female part when the male part is pushed into an engagement position in said female part, so that it is then impossible to pull the male joining part outwards, the male and female joining parts being able to be uncoupled from each other by pushing the male part further into the female part, so that the locking means are released from the catching means and the male joining part can be pulled out from the female joining part.

As a result of these features, the present invention provides a clasp which is easy to use. Indeed, to fasten the clasp, one need only insert the male joining part into the female joining part as far as the engagement position in which the locking means provided on the male part lock with the catching means provided on the female part. In order to open the clasp, the movement of inserting the male part into the female part is continued. The locking means are then released from the catching means, and the male joining part need only be pulled out of the female joining part.

The clasp according to the invention also offers good working reliability. When the male part is pushed into the female part as far as the engagement position, it is impossible to pull said male part out of said female part. Consequently, even if the user inadvertently catches one of the parts of the clasp, it will not open. The clasp will only open if the user intentionally acts on said clasp by pushing the male part further into the female part.

According to a complementary feature of the invention, the locking means are resilient transversely to the direction of engagement of the male joining part in the female joining part, and are resilient in a plane perpendicular to the plane of the clasp.

When the male joining part is inserted in the female joining part, the catching means provided on the female part force the locking means of the male joining part back transversely to the direction of engagement of the male part in the female part in order to deform these locking means resiliently and to put them under tension. The resilient locking means then lock abruptly with the catching means, assuring a secure coupling which prevents any accidental separation. Consequently, when one wishes to open the clasp and the male part is pushed further into the female part, the locking means are deformed resiliently downwards in a direction perpendicular to the plane of the clasp, then they return to their initial shape via the forces of resilience to escape the catching means. The male joining part can then be easily removed from the female joining part.

The clasp according to the invention does not require any setting or adjustment. It also does not include any moving part to release the two coupled joining parts, which allows manufacturing costs to be substantially reduced. Finally, the male and female joining parts can be fitted together quickly and with the greatest of ease, and can be held securely assembled so as to prevent any accidental separation.

BRIEF DESCRIPTION OF THE DRAWINGS

Other features and advantages of the present invention will appear more clearly upon reading the following detailed description of an embodiment example of the clasp according to the invention, this example being given solely by way of non-limiting example, in conjunction with the annexed drawings, in which:

FIGS. 8 to 10 are perspective views showing the operations for uncoupling the male and female joining parts.

DETAILED DESCRIPTION OF THE INVENTION

Figure 1:
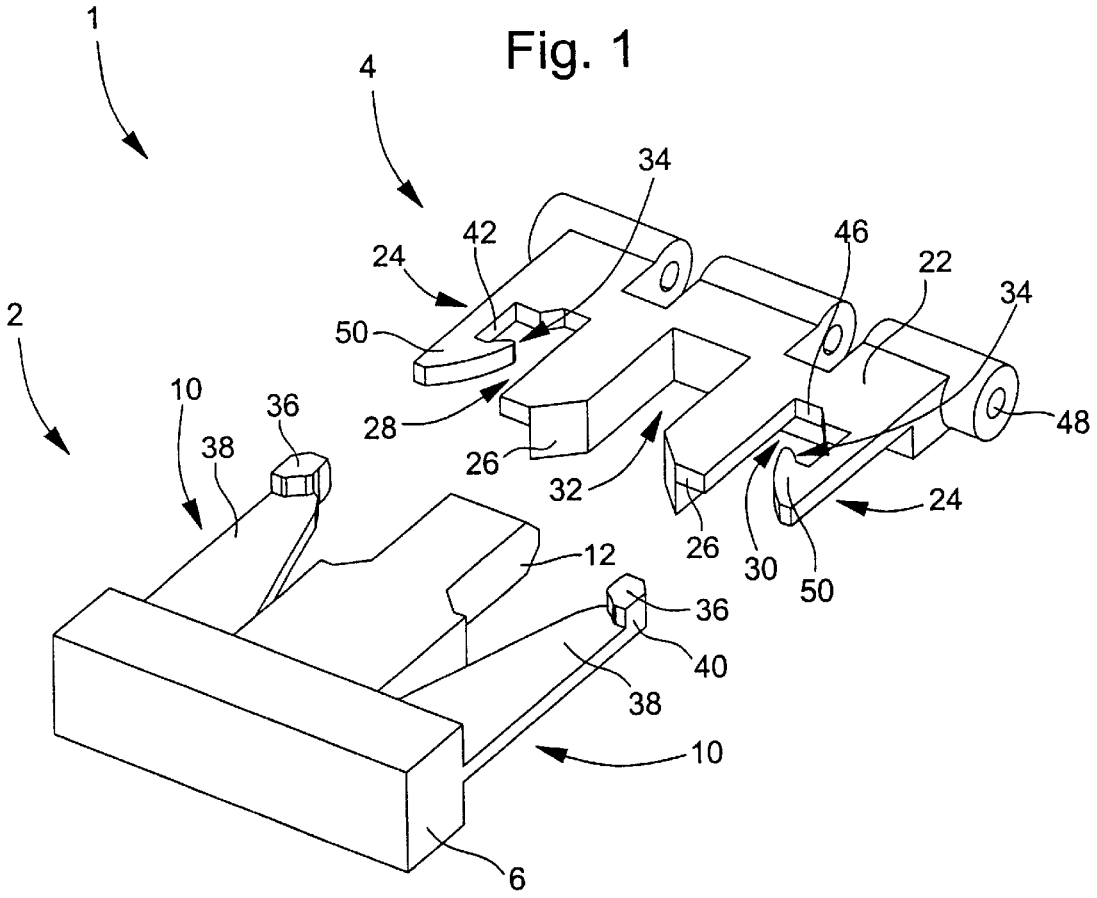
FIG. 1 is a perspective view of the male and female joining parts which form the clasp according to the invention in their detached state.
Figure 3:
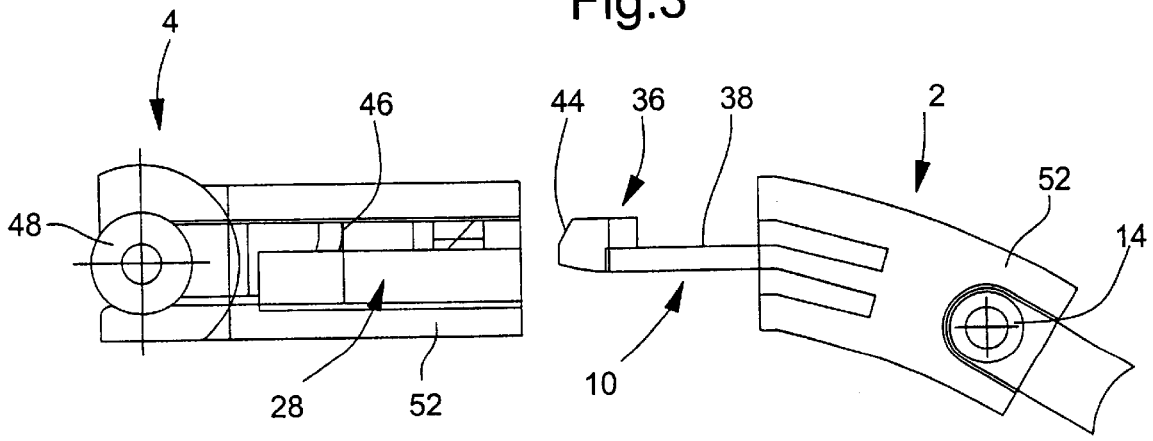
FIG. 3 is a cross-section along the line III—III of FIG. 2, of the male and female joining parts.
Figure 2:
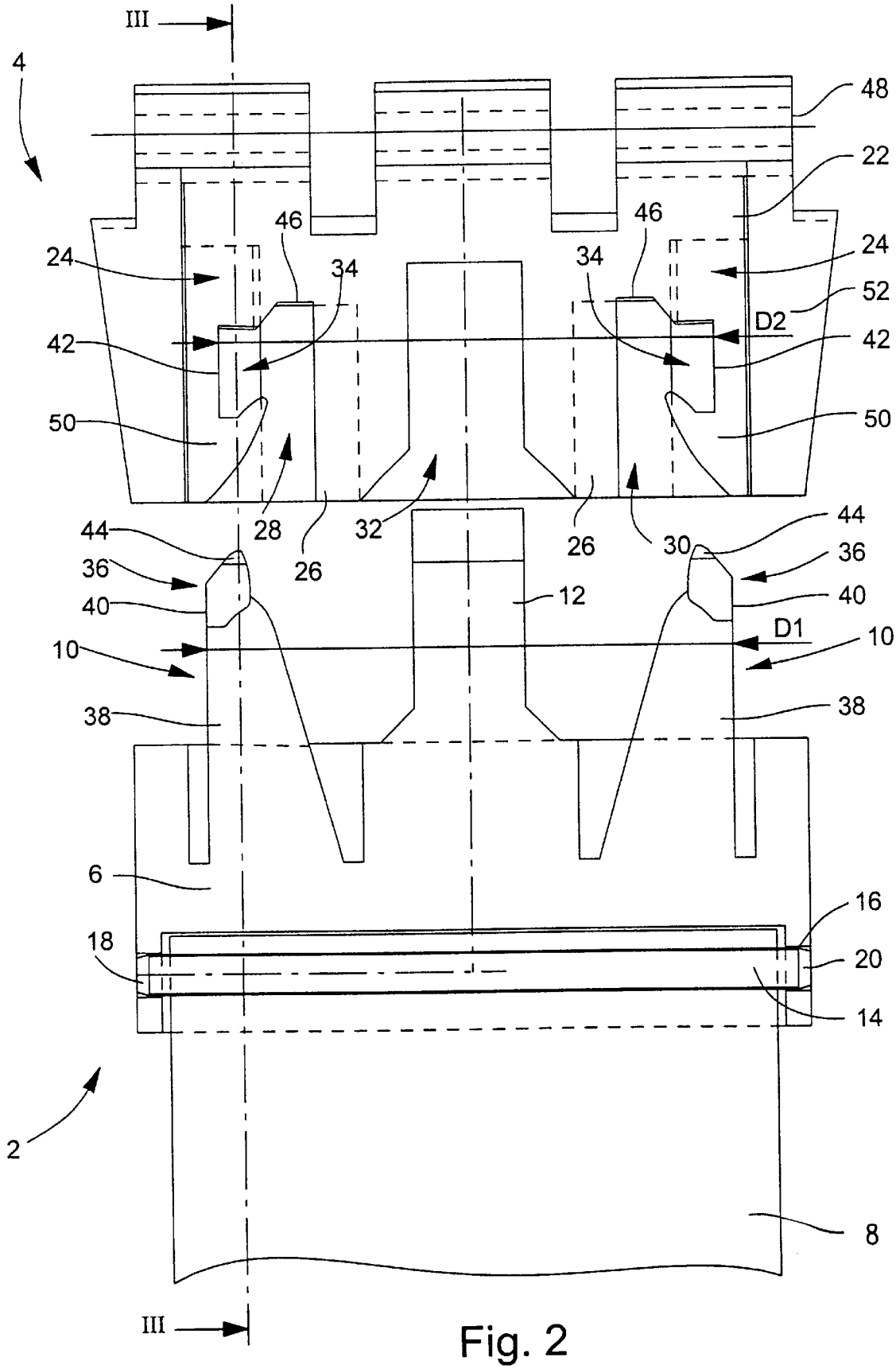
FIG. 2 is a plan view of the male and female joining parts of FIG. 1 in their detached state.

As shown in FIGS. 1 to 3, a clasp according to the present invention, designated as a whole by the general reference numeral 1, is essentially formed of a male joining part 2, intended to be inserted into a female joining part 4. Male part 2 and female part 4 are both made of any type of plastic, metallic, ceramic or other material able to be deformed resiliently.

Male joining part 2 has an overall rectangular shape and includes a transverse connecting bar 6 on the side of one of the strands 8 of a watch wristband (not shown). Locking means are provided on male part 2. In the example shown in FIGS. 1 to 3, these locking means include two tongues 10 which protrude in a perpendicular manner from opposite ends of connecting bar 6 along a common direction, parallel to the direction of engagement of male joining part 2 in female joining part 4. As will be described in more detail hereinafter, these locking means, arranged symmetrically on either side of the axis of introduction of male joining part 2 into female joining part 4, are intended to lock with catching means provided on female part 4 when male part 2 is pushed into the engagement position in said female part 4.

It goes without saying that, according to a simplified variant of clasp 1 according to the present invention, the locking means could include only one tongue 10. However, for reasons of symmetry of male part 2, it is preferable to provide two locking tongues 10 instead of only one. This in fact allows the two male 2 and female 4 parts to be fitted together more quickly and easily and guarantees that said male 2 and female 4 parts will be securely assembled so as to prevent any accidental separation.

Male joining part 2 further includes means for guiding said male joining part 2 into female joining part 4. These guide means take the form of an additional tongue 12 provided between the two locking tongues 10, at an equal distance from the latter, and which extends parallel thereto, i.e. in the direction of insertion of male joining part 2 into female joining part 4. As will be understood upon reading the following description, the guide means are not indispensable for clasp 1 according to the invention to work properly, but they facilitate the introduction of male part 2 into female part 4.

Finally, male joining part 2 includes at its free end means for attaching one of strands 8 of the watch wristband. These attaching means include a bar 14 passing through holes 16 provided at the two ends of connecting bar 6. Wristband strand 8 is fitted onto bar 14 then the latter is inserted into holes 16. Bar 14 may include, for example, two pivots 18 and 20 one of which 18, is stationary, while the other 20 is mobile, subjected to the action of a spring housed inside said bar 14 which pushes it outwards.

Female joining part 4 also has, overall, a generally substantially rectangular shape. Like male joining part 2, it includes a transverse connecting bar 22. Outer 24 and inner 26 arms extend perpendicular to connecting bar 22 in a common direction, parallel to the direction of engagement of male joining part 2 into female joining part 4.

The opposite faces of arms 24 and 26 define two passages 28 and 30 into which locking tongues 10 will slide when male joining part 2 is inserted into female part 4. Optionally, the opposite faces of the two inner arms 26 also define a central passage 32 which will be penetrated by guide tongue 12.

As was mentioned hereinbefore, female joining part 4 includes catching means into which the locking means provided on male part 2 will lock.

More precisely, and as is shown in particular in FIG. 2, these catching means are formed of two notches 34 made in the outer arms 24 and in which the free ends of locking tongues 10 are housed.

For this purpose, each of locking tongues 10 includes at its free end a block 36 which projects above its surface 38 and which is located in the plane of notch 34. When male joining part 2 is introduced into female joining part 4, these blocks 36 will thus be inserted into notches 34 to allow the two male 2 and female 4 parts to be locked together. Blocks 36 each have a plane outer face 40 which is opposite the corresponding notch 34 and which will abut against the bottom 42 of said notch 34 in the engagement position of male joining part 2 in female joining part 4. Finally, blocks 36 also each have a face 44 inclined downwards ending at the free end of locking tongues 10 and which will find support on inner surface 46 facing notch 34 when male joining part 2 will be pushed further into female joining part 4 to open clasp 1.

It will be noted that, like male joining part 2, female joining part 4 includes means for attaching the second wristband strand. These attaching means are formed of one or several cylindrical passage holes 48 provided on the free side of female joining part 4 and intended to accommodate a bar (not shown) to secure the wristband strand.

With reference respectively to FIGS. 4 to 7 on the one hand, and FIGS. 8 to 10 on the other hand, the coupling and uncoupling operations of male joining part 2 and female joining part 4 which form clasp 1 according to the invention will now be described.

Figure 4:
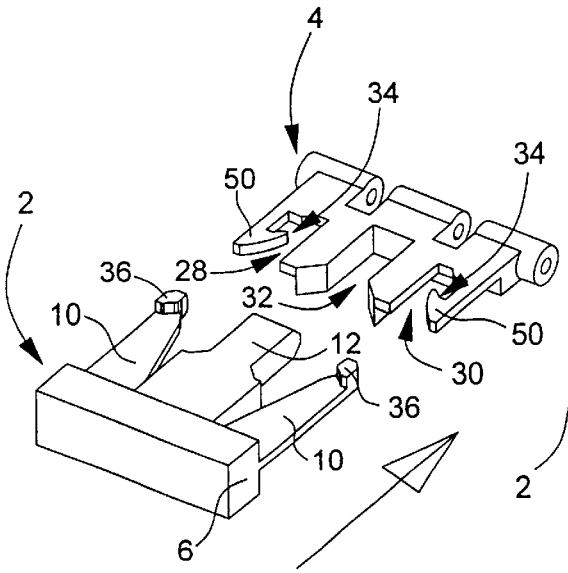
FIGS. 4 to 7 are perspective views showing the operations for coupling the male and female joining parts.

In FIG. 4, male and female joining parts 2 and 4 are in the detached state. The arrow shown in FIG. 4 shows the direction of engagement of male part 2 in female part 4.

Figure 5:
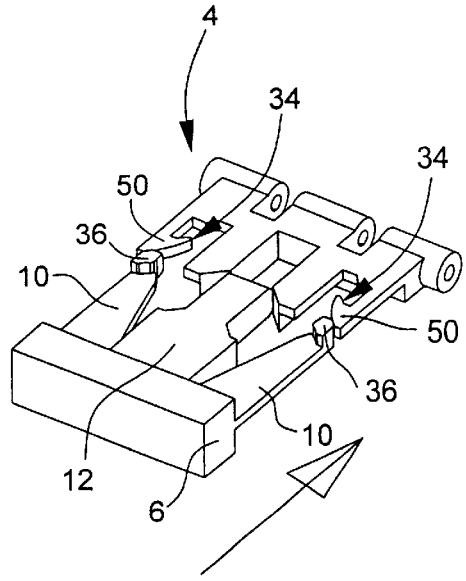

In FIG. 5, male joining part 2 comes into contact with female joining part 4. It can be seen that guide tongue 12 carried by male part 2 begins to penetrate central passage 32 provided on female part 4. It will be recalled once again that guide tongue 12 is not indispensable for clasp 1 according to the invention to work properly, but facilitates the introduction of male part 2 into female part 4 by allowing good axial positioning of these two parts 2 and 4 with respect to each other.

Figure 6:
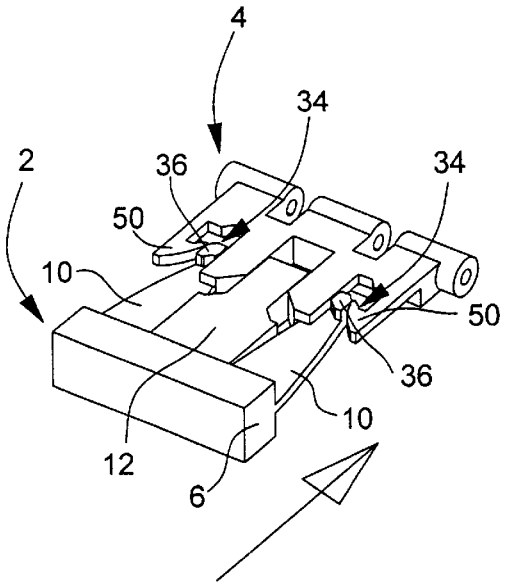

In FIG. 6, locking tongues 10 begin to slide into passages 28 and 30 of female part 4 and are forced back inside by two snugs 50 of the catching means provided on said female part 4. This is made possible owing to the fact that, according to an important feature of the invention, locking tongues 10 are resilient transversely to the direction of introduction of male part 2 into female part 4.

Figure 7:
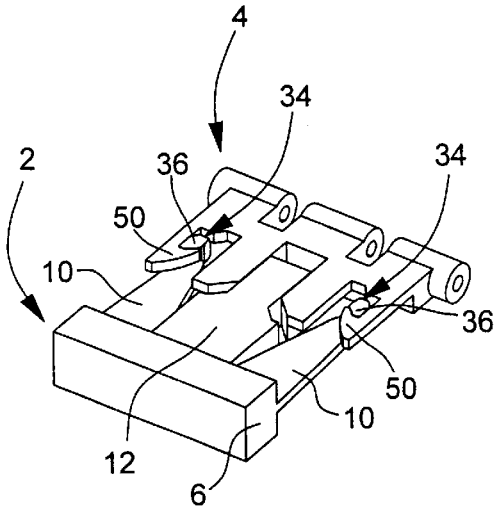

In FIG. 7, the movement of introducing the male part in the direction of the female part is stopped. Since passages 28 and 30 open into notches 34 of the catching means provided on female part 4, blocks 36 which project above surface 38 of locking tongues 10 are abruptly housed in said notches 34. At this stage of operations, it is no longer possible to separate male part 2 from female part 4 by pulling said male part 2 since the aforecited snugs 50 prevent blocks 36 being removed. It will further be noted that, as is visible in FIG.

2, the gap D1 between the two locking tongues 10 is greater than the distance D2 which separates the bottoms 42 of notches 34. Consequently, locking tongues 10 are at this moment under elastic tension and blocks 36 which carry these tongues 10 are applied closely via their plane outer faces 40 against the bottoms 42 of notches 34.

The operations for uncoupling male and female joining parts 2 and 4 will now be considered.

FIG. 8 is a similar view to that of FIG. 7, except that male joining part 2 is pushed further into female joining part 4, which is represented by an arrow in the Figure. According to another important feature of the invention, locking tongues 10 are also resilient perpendicular to the plane of clasp 1 according to the invention. Thus, when male part 2 is pushed into female part 4, the downward inclined surfaces 44 of blocks 36 find support and slide gradually over the inner surfaces 46 facing notches 34. Locking tongues 10 are then released from notches 34 by inclining downwards, then they return to their initial shape by the forces of resilience. One need only then exert a movement of traction along the arrow shown in the Figure on male part 2 to remove it from female part 4. Since the gap D1 between locking tongues 10 is greater than the distance which separates the bottoms 42 of notches 34, blocks 36 carried by said locking tongues 10 slide along the lower outer surface of arms 24 and thus are not liable to be housed in notches 34 again.

In FIG. 10 male and female joining parts 2 and 4 are again in the detached state.

It will be noted that male and female joining parts 2 and 4 may each be inserted in a case 52 (see FIGS. 2 and 3).

It goes without saying that the invention is not limited to the embodiment which has just been described and that modifications and variants can be envisaged by those skilled in the art without departing from the scope of the present invention.

What is claimed is:

1. A clasp for a watch wristband, wherein said clasp includes male and female joining parts able to be coupled by inserting the male part into the female part, resilient locking means, provided on the male part, locking with catching means provided on the female part, so that it is then impossible to pull the male joining part outwards, the male and female joining parts being able to be uncoupled from each other by pushing the male part further into the female part, when the male part is pushed in a direction into an engagement position in said female part, so that the locking means are released from the catching means and the male joining part can be pulled out of the female joining part, wherein the locking means are resilient transversely to the direction of engagement of the male joining part in the female joining part, and resilient in a plane perpendicular to a plane of the clasp.

2. A clasp according to claim 1, wherein the male and female joining parts are made of a plastic, metallic, ceramic or other material able to be resiliently deformed.

3. A clasp according to claim 1, wherein the male and female joining parts each include means for attaching a first and a second wristband strand.

4. A clasp according to claim 3, wherein the attaching means are formed by a bar passing through holes provided in a free end of the male and female joining parts.

5. A clasp according to claim 1, wherein the catching means force back the locking means in order to cause resilient deformation of said locking means transversely to the direction of engagement of the male joining part in the female joining part when said male joining part is fitted into said female joining part, and in that the locking means are deformed resiliently downwards along a direction perpendicular to the plane of the clasp, then returned to their initial shape by the forces of resilience when the male part is pushed further into the female part.

6. A clasp according to claim 5, wherein the locking means include at least one locking tongue extending parallel to the direction of engagement of the male joining part in the female joining part, and wherein the catching means include a notch in which a free end of the locking tongue will be housed.

7. A clasp according to claim 6, wherein the locking means include two locking tongues, wherein the catching means include two notches, and wherein a gap between the two locking tongues is greater than the distance which separates bottoms of the notches.

8. A clasp according to claim 6, wherein the female joining part includes a passage which opens out into the notch and into which the locking tongue slides when the male part is introduced into the female part.

9. A clasp according to claim 6, wherein the locking tongue includes, at its free end, a block which projects above its surface and which is located in the plane of the notch in which the block is housed.

10. A clasp according to claim 9, wherein the block has a plane outer face which is opposite to the notch and which abuts against the bottom of said notch in the engagement position of the male joining part in the female joining part.

11. A clasp according to claim 9, wherein the block also has a downward inclined face which ends at the free end of the locking tongue and which finds support on the inner surface of the notch when the male part is pushed further into the female part to open the clasp, so that the free end of the locking tongue is released from the notch by inclining downwards and outwards as a result of its transverse resilience.

12. A clasp according to claim 6, wherein the male joining part further includes means for guiding said male part in the female joining part.

13. A clasp according to claim 12, wherein the guiding means include a guide tongue extending parallel to the direction of insertion of the male joining part into the female joining part, and wherein the female joining part includes a passage into which the guide tongue slides when the male part is introduced into the female part.

14. A clasp according to claim 13, wherein there are two locking tongues disposed symmetrically on either side of the direction of engagement of the male joining part in the female joining part, and wherein the guide tongue is provided between the two locking tongues.

15. A clasp for a watch wristband, wherein said clasp includes male and female joining parts able to be coupled by inserting the male part into the female part, resilient locking means, provided on the male part, locking with catching means provided on the female part, so that it is then impossible to pull the male joining part outwards, the male and female joining parts being able to be uncoupled from each other by pushing the male part further into the female part, when the male part is pushed in a direction into an engagement position in said female part, so that the locking means are released from the catching means and the male joining part can be pulled out of the female joining part, wherein the male and female joining parts are each inserted into a case.

* * * * *